United States Patent [19]

Aarts

[11] Patent Number: 4,529,010

[45] Date of Patent: Jul. 16, 1985

[54] SHUTTLELESS WEAVING MACHINE COMPRISING MEANS FOR REMOVING FAULTY WEFT THREADS FROM THE WEAVING SHED

[75] Inventor: Hubertus H. Aarts, Deurne, Netherlands

[73] Assignee: Ruti-Te Strake B.V., Netherlands

[21] Appl. No.: 554,348

[22] Filed: Nov. 22, 1983

[30] Foreign Application Priority Data

Dec. 1, 1982 [NL] Netherlands ..... 8204665

[51] Int. Cl.[3] ..... D03D 49/00

[52] U.S. Cl. ..... 139/1 R; 139/429; 139/116

[58] Field of Search ..... 139/429, 1 R, 116, 450, 139/443, 444, 445, 446

[56] References Cited

U.S. PATENT DOCUMENTS 3,805,850 4/1974 Van Duynhoven ..... 139/1 E
4,007,457 2/1977 Aeppli ..... 242/36
4,448,223 5/1984 Deborde ..... 139/435
4,450,876 5/1984 Van Mullekom ..... 139/435
4,463,783 8/1984 Suzuki ..... 139/1 R

FOREIGN PATENT DOCUMENTS 2065726 7/1981 United Kingdom ..... 139/1 R

*Primary Examiner*—Henry S. Jaudon
*Assistant Examiner*—Steven Shongut
*Attorney, Agent, or Firm*—Burns, Doane, Swecker & Mathis

[57] ABSTRACT

This weaving machine comprises a device for removing faulty weft threads from the weaving shed or the woven cloth respectively, also if they have already been cut from the yarn supply during the weaving cycle. The device has a reciprocatable mechanical removing member (8) by means of which also fibrous yarn threads may be removed from the beating up line. Furthermore the device comprises a catching element (10) for threads which have already been cut, which element is adapted to clamp and take along the thread.

9 Claims, 7 Drawing Figures

Figure 1:
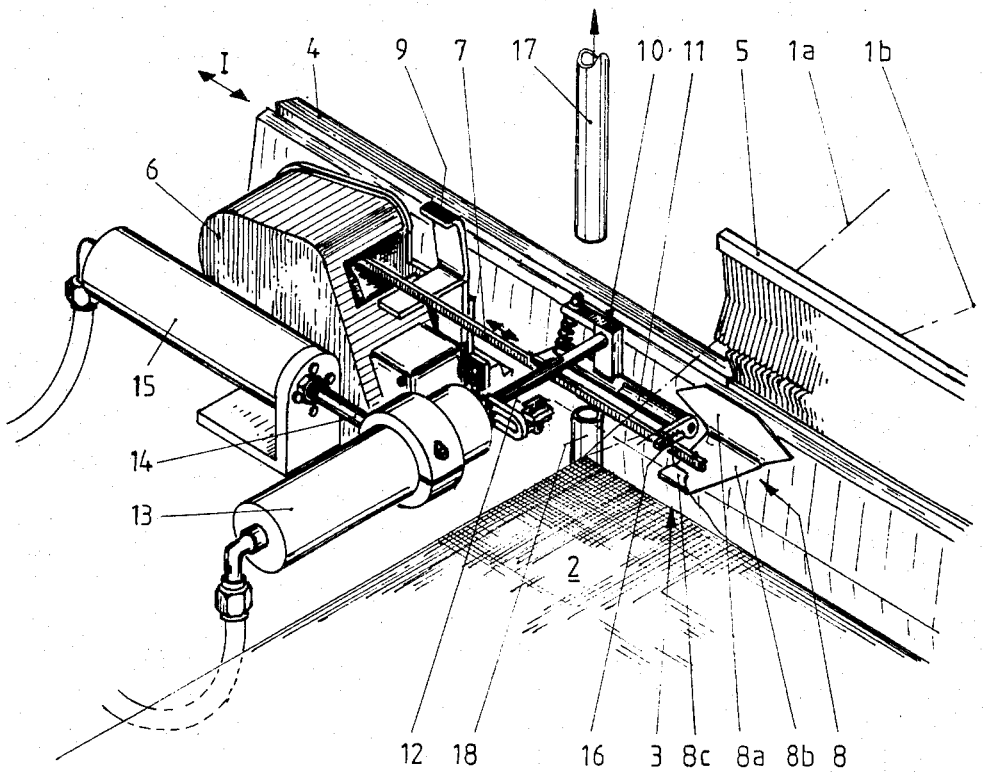

SHUTTLELESS WEAVING MACHINE COMPRISING MEANS FOR REMOVING FAULTY WEFT THREADS FROM THE WEAVING SHED

The invention relates to a shuttleless weaving machine comprising a detector for tracing defects in weft threads and comprising means for removing faulty weft threads from the weaving shed, the detector cooperating such with the driving apparatus of the weaving machine that the main machine shaft is reversed through a certain angle at a fault signal of the detector, whereby the latest weaving shed change is put back in order to cancel the weave between the warp threads and the defective weft thread.

Such a weaving machine is e.g. known from the Dutch Pat. No. 146,551.

The means whereby the faulty weft thread is removed from the weaving shed, after the weave with the warp threads has been cancelled by reversing the main machine shaft, are thereby constituted by the blowing nozzles arranged between the weaving shed ends which are supplied with transport air and serve for the thread transport through the weaving shed during normal operation of the machine. A condition therewith is that the faulty weft thread length remains connected with the weft yarn supply. Therein it is assumed that when the next weft is inserted the faulty weft thread is gradually pulled away from warp threads meeting at the beating up line, starting at the insert side of the weaving shed and is discharged through the weaving shed in the insert direction towards the suction nozzle. The faulty weft thread has first to enter the operative area of the first blowing nozzle before the blowing nozzles are able to perform said task. For that purpose at the insert side a catching element is provided adjacent to the cloth edge which is movable in a direction contrary to the reed beating up movement, controlled by the fault signal, for moving the portion of the faulty weft thread that projects beyond the weaving shed at that cloth edge along a certain distance from the beating up line in the cloth.

The invention aims at improving said machine. For that purpose the means for removing a faulty weft thread from the weaving shed are constituted in the machine according to the invention by a member which is positioned at the insert side of the machine and is movable from an inoperative position, in the weft direction through the weaving shed and back, which member is adapted for moving in its first stroke the faulty weft thread through a distance contrary to the beating up direction from the beating up line in the cloth.

It is therewith understood that the removing member according to the invention is connected in the control circuit of the machine such that it becomes only operative after the main machine shaft has been reversed, the latest weaving shed change has been put back thereby and therefore the weave between the warp threads and the faulty weft thread has been cancelled.

Through the removing member according to the invention weft yarns of different type and particularly also relatively fibrous yarns which tend to stick together in their rest condition along the beating up line in the cloth may be effectively removed from the beating up line. In those cases in which the faulty weft thread, as with the known apparatus, is still connected with the weft yarn supply there would, moreover, be no need for the catching element which is movable in the known apparatus along the cloth edge at the insert side since the removing member according to the invention could simultaneously perform the function of that catching element.

In a preferably applied embodiment of the machine according to the invention, nevertheless, a similar catching element, movable along the cloth edge at the insert side, is used, namely such that the catching element is also adapted to clamp the faulty weft thread. Thereby the possibility exists to discharge faulty weft threads which had already been cut from the weft yarn supply before the fault signal could influence the relative weaving cycle. In that case after the fault signal has been issued, after reversing the main machine shaft, first the catching element becomes operative before the removing member completely removes the faulty weft thread from the beating up line in the cloth.

In a practical embodiment the removing member is secured to the end of a flexible belt which may be wound and dewound from a roller mounted at the insert side. It is to be noted in this connection that similar belts are used in the weft conveyors of so called gripper looms.

The invention is hereunder further explained with reference to the drawings of an embodiment given as an example.

FIG. 1 is a perspective view of the device for repairing weaving errors according to the invention, also showing portions of a shuttleless weaving machine and FIGS. 2 to 7 shows schematically six successive operation phases of said device.

In the drawing reference number 1 indicates the weaving shed limited by the upper and lower warp threads 1*a* and 1*b*, while reference number 2 indicates the cloth and reference number 3 the beating up line. The reed beam 4 which is reciprocatable in the direction of the arrow I is shown in the drawing in its retracted position and carries the reed indicated by reference number 5.

On the end of the reed beam 4 projecting beyond the cloth edge normally there is provided the weft device e.g. supplied with pressurized air, which device, however, is not further shown in FIG. 1.

A housing 6 is secured to the projecting portion of the reed beam 4, which housing contains a rotatably mounted spool which is not visible in the drawing, to which spool a flexible belt 7 e.g. manufactured from thin spring steel is secured and adapted to be wound and dewound in the insert direction.

In the reed position shown in the drawing the free end of the belt 7 is opposite to the left end of the weaving shed. A member 8 is secured to said free belt end and comprises an upright guiding portion 8*a*, a horizontal portion 8*b* connected to the belt 7 and a curved removing portion 8*c* directed toward the beating up line 3.

During normal weaving operation the belt 7 with the member 8 are in an inoperative position in which the member 8 is supported by a catching element 9 secured to the housing 6.

It is assumed with the error repair device shown in FIG. 1 that in the moment in which the defect is observed the faulty weft thread has already been cut by the cutting device not further shown in the drawing from the weft yarn supply which likewise is not shown in the drawing. This means that the faulty weft thread has first to be brought at the insert side in a position suitable for further handling by the removing member 8. Therefore the catching element 10 is used which comprises a rod shaped portion 11 extending in the weft direction in the position according to FIG. 1, which portion is secured to the end of a piston rod 12 of a pneumatic piston cylinder device 13, said rod extending in the warp direction. Thereby the catching element 10 is reciprocatable in the warp direction by means of the piston cylinder device 13. The piston cylinder device 13 in its turn is secured to the free end of the piston rod 14 of a second penumatic piston cylinder device 15, the cylinder of which is rigidly mounted to the weaving machine frame not further shown. Through the second piston cylinder device 15 the catching element 10, is, moreover, reciprocatable in the weft direction.

The catching element 10 is furthermore rotatable through an angle of e.g. 90° between the horizontal position shown in FIG. 1 and an upright position. The rod shaped portion 11 of the catching element 10 carries at its end a thread clamp 16 comprising a stationary and a pivotal jaw. The pivotal jaw is secured to a rod which is rotatably journalled within the rod shaped part 11 and projects at its other end beyond the rod shaped part 11 so that it is adapted to cooperate thereby with an actuating cam.

An auxiliary suction tube 17 is mounted in an upright position on a stationary portion (not shown) of the machine frame. The auxiliary suction tube 17 is connected to a suction source (not shown) so as to create an upward suction air flow. An auxiliary blowing nozzle 18 is also mounted in a stationary upward position and is adapted to deliver a jet of pressurized air directed upwardly towards the lower inlet end of the auxiliary suction tube 17.

The operation of the weaving error repair device is hereunder further explained with reference to the schematic drawings in FIGS. 2 to 7.

Figure 2:
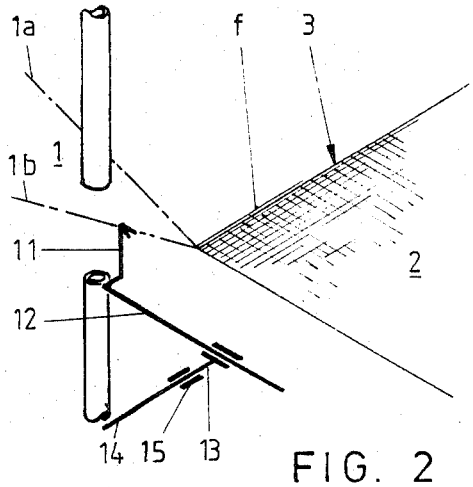
Figure 3:
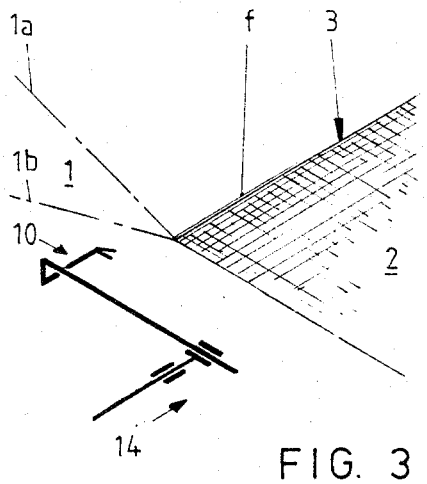
Figure 4:
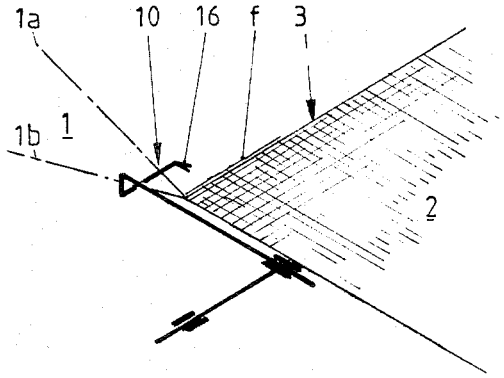
Figure 5:
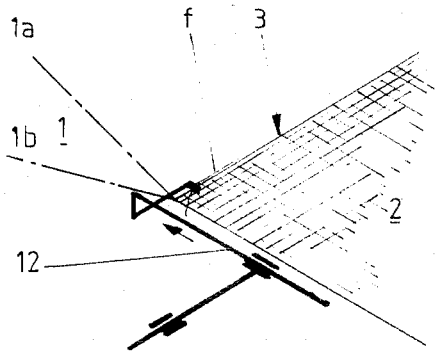
Figure 6:
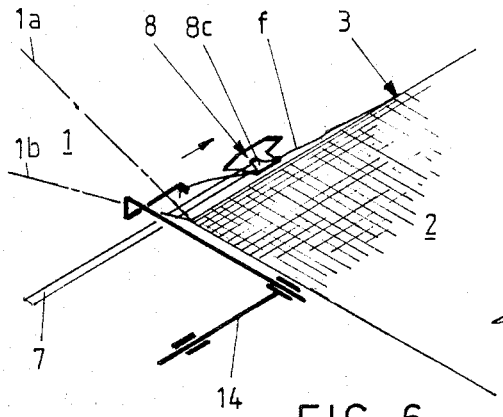

FIG. 2 shows the situation in which the faulty weft thread is still contacting the beating up line 3 along its full length. It is assumed that the main machine shaft has been reversed in the meantime so far that the faulty weft is no longer interwoven with the cloth 2 and that the machine has come to standstill with the reed in the retracted position. The piston rod 14 of the second piston cylinder device 15 is in its retracted position which means that the catching element 10, as seen in the weft direction, takes a retracted position. The rod shaped part 11 is in its upright position. Furthermore the piston rod 12 of the first piston cylinder device 13 is likewise in its retracted position so that the catching element 10 as considered relative to the retracting reed movement likewise is in a retracted position. From the position according to FIG. 2 the catching element 10 is moved by a movement, in the direction of the arrow, of the piston rod 12 and a rotary movement of the rod shaped part 11, likewise in the direction of the arrow, to the position according to FIG. 3 from which the catching element 10 may be moved by a movement of the piston rod 14 in the direction of the arrow into the position according to FIG. 4 in which the catching element 10 has arrived with its rod shaped part 11 in the horizontal position within the weaving shed. From the situation in FIG. 4 the catching element is moved with its yarn clamp in the direction of the beating up line 3 by a retracting movement of the piston rod 12. Thereby the situation according to FIG. 5 is reached in which the catching element has catched and clamped the faulty weft thread f by means of the thread clamp 16. From the position according to FIG. 5 the catching element is retracted together with the catched faulty weft thread end from the beating up line 3 by again moving the piston rod 12 outwardly with respect to the cylinder 13. The catching element then arrives in the position according to FIG. 6 which corresponds to that of FIG. 4 but in which also the portion of the faulty weft thread f situated at the insert side has been removed through a distance from the beating up line 3. Thereby the portion of the faulty weft thread situated at the insert side has arrived in the path of the removing member 8 which performs in the situation according to FIG. 6 its removing movement in the direction of the arrow. It also appears from FIG. 6 in which manner the curved portion **8*c* of the removing member 8 gradually pulls the faulty weft thread away from the beating up line 3**.

Figure 7:
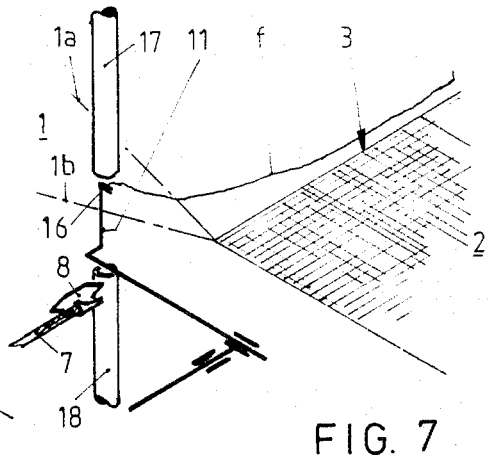

As soon as the removing member 10 has completed its movement in the weaving shed and thereby the faulty weft thread has been made free along its full length from the beating up line and from the upper and lower warp threads, the catching element 10 is moved by a retracting movement of the piston rod 14 and a successive rotary movement of the rod shaped part 11 in the situation according to FIG. 7 in which the clamped end of the faulty weft thread f is present at the mouth of the auxiliary suction tube 17. Pressurized air is now supplied to the auxiliary blowing nozzle 18, while opening the clamp 16, so as to create an air jet which carries the released faulty weft thread towards the auxiliary suction tube 17 to be completely discharged by the tube 17. In the meantime the member 8 may return to its retracted position adjacent to the housing 6 (FIG. 1) after which the piston rod 12 may again be retracted into its cylinder 13 in order to return the catching element 10 in the starting position according to FIG. 2.

I claim:

1. Shuttleless weaving machine comprising a detector for tracing defects in weft threads and comprising means for removing faulty weft threads from the weaving shed, in which the detector cooperates with the driving apparatus of the weaving machine such that the main machine shaft is reversed through a certain angle at a fault signal of the detector and thereby the latest weaving shed change is put back in order to cancel the weave between the warp threads and the faulty weft thread, characterized in that the means for removing a faulty weft thread from the weaving shed are constituted by a member positioned at the insert side of the machine which is reciprocatable from an inoperative position, in the weft direction through the weaving shed, which member is adapted to move in its operative stroke the faulty weft thread through a distance contrary to the beating up direction from the beating up line in the cloth.

2. Machine according to claim 1 characterized in that the removing member is secured to the end of a flexible belt which is adapted to be wound and dewound onto and from a roller mounted at the insert side.

3. Machine according to claim 2 in which a catching element is present adjacent to the cloth edge and the insert side, which element is movable as controlled by the fault signal in a direction contrary to that of the reed beating up movement, in order to move the end of the faulty weft thread projecting beyond the weaving shed through a distance from the beating up line, characterized in that the catching element is provided with a thread clamp.

4. Machine according to claim 2, characterized in that the removing member comprises at one side an upright guiding portion and at the other side facing the beating up line comprises a curved portion, the convex side of which faces the beating up line.

5. Machine according to claim 4 in which a catching element is present adjacent to the cloth edge and the insert side, which element is movable as controlled by the fault signal in a direction contrary to that of the reed beating up movement, in order to move the end of the faulty weft thread projecting beyond the weaving shed through a distance from the beating up line, characterized in that the catching element is provided with a thread clamp.

6. Machine according to claim 1 in which a catching element is present adjacent to the cloth edge and the insert side, which element is movable as controlled by the fault signal in a direction contrary to that of the reed beating up movement, in order to move the end of the faulty weft thread projecting beyond the weaving shed through a distance from the beating up line, characterized in that the catching element is provided with a thread clamp.

7. Weaving machine according to claim 6, characterized in that the catching element is also reciprocatable in the weft direction between a position outside and a position inside the weaving shed.

8. Weaving machine according to claim 7, characterized in that the catching element comprises a rod shaped portion which is rotatable in a plane perpendicular to the warp direction between a horizontal position parallel to the weft direction and an upright position outside the weaving shed.

9. Weaving machine according to claim 8 characterized by an auxiliary suction nozzle at the insert side, the mouth of said nozzle being present adjacent to the thread clamp in the upright position of the rod shaped portion of the catching element.

* * * * *